United States Patent [19]

Reimer

[11] Patent Number: 4,505,528

[45] Date of Patent: Mar. 19, 1985

[54] LOW INSERTION FORCE CONNECTION ARRANGEMENT

[75] Inventor: William A. Reimer, Wheaton, Ill.

[73] Assignee: GTE Automatic Electric Inc., Northlake, Ill.

[21] Appl. No.: 527,639

[22] Filed: Aug. 29, 1983

[51] Int. Cl.[3] ..... H01R 9/09

[52] U.S. Cl. ..... 339/17 LM; 339/74 R; 339/176 MP; 339/205

[58] Field of Search ..... 339/17 L, 17 LM, 74 R, 339/75 MP, 176 MP, 204, 205

[56] References Cited

U.S. PATENT DOCUMENTS

| | | | |
|---|---|---|---|
| 3,611,259 | 10/1971 | Palecek | 339/74 R |
| 4,176,900 | 12/1979 | Hines et al. | 339/176 MP |
| 4,230,388 | 10/1980 | Thierry et al. | 339/74 R |
| 4,274,699 | 6/1981 | Keim | 339/176 MP |
| 4,275,944 | 6/1981 | Sochor | 339/74 R |
| 4,327,955 | 5/1982 | Minter | 339/75 MP |
| 4,400,049 | 8/1983 | Schuck | 339/17 LM |

*Primary Examiner*—John McQuade

*Attorney, Agent, or Firm*—Robert J. Black; Gregory G. Hendricks

[57] ABSTRACT

A low insertion force connection arrangement for establishing a connection between at least two printed wiring boards, each board of the type including at least one printed wiring board terminal. The connection arrangement includes at least one connection spring having a pivot point facing away from the printed wiring boards and located between two actuator engaging areas. The actuator engaging areas face the printed wiring boards and are located between two contacts. The contacts are located at opposite ends of the connection spring facing and in alignment a corresponding terminal of each of the printed wiring boards. A connector body is provided including a plurality of grooves each adapted to receive and retain one of the printed wiring boards in alignment with the other boards, and a plurality of spring receiving cavities, each cavity enclosing a pair of connection springs and including a molded-in fulcrum opposite each spring's pivot point. Recesses are formed in opposite cavity walls proximate each of the molded-in fulcrum ends. Each of the connection springs is retained within a respective cavity by means of the spring fingers acting against the recesses. Actuators engage the actuator engaging areas to pivot each connection spring and disengage the spring from the terminals to thus permit insertion of the printed wiring boards within their respective grooves. The actuators are then disengaged from the actuator engaging areas to permit the springs to restore and engage the printed wiring board terminals.

20 Claims, 4 Drawing Figures

LOW INSERTION FORCE CONNECTION ARRANGEMENT

CROSS-REFERENCES TO RELATED APPLICATIONS

Related, commonly assigned, co-pending applications include "Printed Wiring Board File," Ser. No. 527,635, "Double File Printed Wiring Board Module," Ser. No. 527,634, "Printed Wiring Board Interconnect Arrangement," Ser. No. 527,636, "Low Insertion Force Connection Arrangement," Ser. No. 527,637, and "Low Insertion Force Connection Arrangement," Ser. No. 527,638, all filed concurrently herewith and invented by the same inventor.

BACKGROUND OF THE INVENTION

The present invention relates to arrangements for establishing connection to printed wiring boards and more particularly to a low insertion force arrangement for interconnecting two or more printed wiring boards.

Printed wiring board interconnect arrangements are very well know to those skilled in the art. One type, described in U.S. Pat. No. 3,771,100 issued on Nov. 6, 1973 to Norman Leonard Reed. This type includes a contact which is integrally formed by folding a sheet metal blank. It comprises a pair of elongated spring arms supported longitudinally and spaced apart at one of their ends by an elongated body portion. The arms extend in opposite directions away from their supporting ends and each arm extends toward the supporting end of the other arm so that they overlap or cross. Contact portions are located at the free ends of each arm adjacent to the supported end of the other arm and they face away from the spring body. Each contact is mounted in a slot within a carrier block of insulating material by latch arms formed on the body portion which project away from the spring arms and engage a shoulder formed in the carrier block.

Another arrangement for interconnecting printed wiring boards is described in U.S. Pat. No. 3,871,736 which issued in Mar. 18, 1975 to Carter, et al. This patent teaches an electrical connector mounted in a housing to electrically and mechanically interconnect a pair of parallel adjacent printed wiring boards and to connect the printed wiring boards to an adjacent terminal. Pairs of resilient, parallel, spaced apart legs extend from a connector body and are adapted to resiliently grip the printed wiring boards therebetween.

U.S. Pat. No. 4,255,003, which issued on Mar. 10, 1981 to William E. Berg, teaches an electrical connector for interconnecting conductive paths of two circuit elements by means of the following: A contact member including a concave portion interposed between two convex portions; a resilient member conforming to the contact member in part; and a connector body, so formed that when the body is forced against the circular elements, the resilient member forces the contact member into engagement with the circuit element conductive paths.

Devices permitting connection to printed wiring boards are also well known in the art. In this regard, zero insertion force, edge board connectors have been disclosed in U.S. Pat. No. 4,189,200 issued Feb. 19, 1980 to Yeager, et al, and U.S. Pat. No. 4,159,861 issued July 3, 1979 to Anhalt. These connectors include cantilevered contacts biased toward the printed wiring board and positioned out of engagement with the board for insertion purposes. Connectors including cantilevered contacts biased against the printed wiring board and temporarily retracted from contact with the board directly by means of an actuator are disclosed in U.S. Pat. No. 3,793,609 issued Feb. 19, 1974 to McIver, and U.S. Pat. No. 3,848,221 issued Nov. 12, 1974 to Lee. Finally, a low insertion force connector including cantilevered contacts biased out of engagement with the printed wiring board and positioned into engagement with the printed wiring board through the use of actuators is taught in U.S. Pat. No. 4,176,900 issued Dec. 4, 1979 to Heinz, et al.

The art cited is seen to teach various arrangements of cantilevered or resiliently biased contact springs for connecting to or interconnecting printed wiring boards.

SUMMARY OF THE INVENTION

The present invention provides a low insertion force arrangement for establishing a connection between at least two printed wiring boards. Each board is of the type that includes at least one printed wiring board terminal. The connection arrangement includes the following: at least one connection spring having first and second contacts, each contact engageably positioned relative to a corresponding one of the terminals; a pivot point; and first and second actuator engaging areas. A fulcrum is included in the arrangement and is positioned to engage the spring at the pivot point. First and second actuators are also included and located proximate to the spring at the actuator engaging areas. Each actuator is positioned in a first position relative to the spring to pivot the spring and engage a respective one of the contacts with its respective terminal. Each actuator is further positioned in a second position relative to the spring to pivot the spring and disengage the respective contact from its respective terminal.

BRIEF DESCRIPTION OF THE DRAWING

Various features and advantages of a zero insertion force connection arrangement in accordance with the present invention will be apparent from the following description taken in conjunction with the accompanying drawing in which.

DETAILED DESCRIPTION OF THE INVENTION

Figure 1:
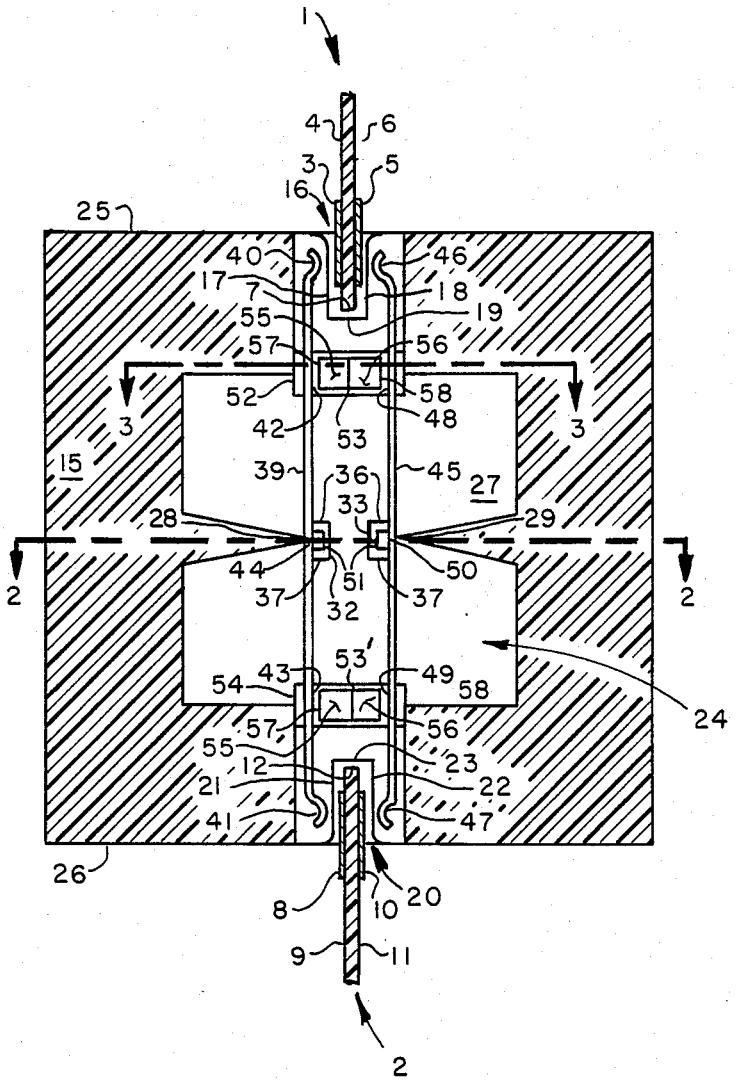
FIG. 1 is a cross sectional view of a zero insertion force connection arrangement for two printed wiring boards in accordance with the present invention.

Referring now to FIG. 1 there is shown an arrangement for connecting a first printed wiring board 1 to a second printed wiring board 2. The first printed wiring board 1 includes a first plurality of terminals 3 located on a first side 4 and a second plurality of terminals 5 located on a second side 6. The first terminals 3 and the second terminals 5 are located near an edge 7 of the first printed wiring board 1. Similarly, the second printed wiring board 2 includes a first plurality of terminals 8 located on a first surface 9 and a second plurality of terminals 10 located on a second surface 11. The first plurality of terminals 8 and the second plurality of terminals 10 are located near an edge 12 of the second printed wiring board.

A connector body 15 is provided with a first groove 16 including a first wall 17, a second wall 18, and a floor 19. The connector body 15 also includes a second groove 20 including a first wall 21, a second wall 22, and a floor 23.

Figure 2:
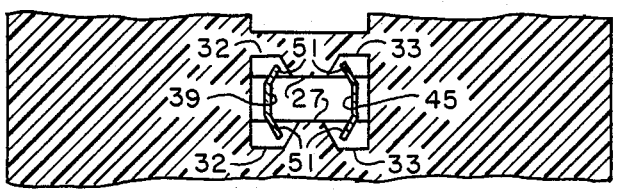
FIG. 2 is a sectional view taken along line 2—2 in FIG. 1.

A plurality of spring receiving cavities 24 are formed in the connector body 15 in alignment with corresponding groups of one of each of the terminals 3, 5, 8, and 10. The cavities 24 extend between a first side 25 and a second side 26 of the connector body 15 and include a pair of parallel opposite walls 27 (such walls are shown in FIG. 2). A first fulcrum 28 and a second fulcrum 29 are formed centrally located and between the opposite walls 27 of each of the spring receiving cavities 24.

Referring to FIG. 2, a first pair of recesses 32 and a second pair of recesses 33 are formed in the walls 27 of each of the spring receiving cavities 24 near the first and second fulcrums 28 and 29 respectively. Referring again to FIG. 1, each of the recesses 32 and 33 includes an upper edge 36 and a lower edge 37. Each of the spring receiving cavities 24 intersects the first printed wiring board receiving groove 16 and the second printed wiring board receiving groove 20.

Each of the spring receiving cavities 24 includes an elongated first spring 39 positioned therein. Each of the first springs 39 includes a first contact 40, a second contact 41 positioned at opposite ends thereof. The first contact 40 of each of the first springs 39 is positioned proximate to a corresponding one of the first contacts 3 of the first printed wiring board 1 and the second contact 41 of the first spring 39 is positioned proximate to a corresponding one of the first contacts 8 of the second printed wiring board 2. Each of the first springs 39 includes a first actuator engaging area 42 and a second actuator engaging area 43 positioned on a side of the spring facing toward the printed wiring boards 1 and 2 and located between the first contact 40 and the second contact 41. A pivot point 44 is positioned on a side of each of the first springs 39 facing away from the printed wiring boards 1 and 2 and located between the actuator engaging areas 42 and 43. Similarly, each of the spring receiving cavities 25 includes a second spring 45 including a first contact 46 positioned proximate to a corresponding one of the second terminals 5 of first printed wiring board 1 and a second contact 47 positioned proximate to a corresponding one of the second terminals 10 of the printed wiring board 2. Each of the second springs 45 includes a first actuator engaging area 48 and a second actuator engaging area 49 positioned on a side of the spring facing toward the printed wiring boards 1 and 2 and located between the first contact 46 and the second contact 47. A pivot point 50 is positioned on a side of the second spring 45 facing away from the printed wiring boards 1 and 2 and located between the actuator engaging areas 48 and 49. The pivot points 44 and 50 are positioned to engage fulcrums 28 and 29 respectively when the springs 39 and 45 are operated as described below.

Referring to FIG. 2, each of the first springs 39 and the second springs 45 includes a pair of retaining fingers 51 to retain each of the springs within each of their spring receiving cavities 24 while permitting spring movement about the pivot points 28 and 29 respectively. Referring again to FIG. 1, the pairs of retaining fingers 51 are attached to each of the first springs 39 near the pivot point 44 and to each of the second springs 45 near the pivot point 50.

Figure 3:
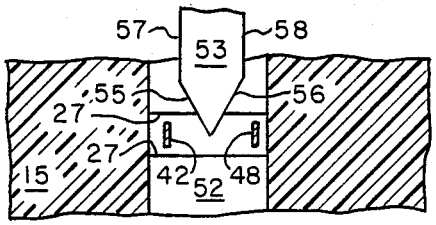
FIG. 3 is a sectional view taken along line 3—3 in FIG. 1.

Referring to FIG. 3, a first actuator 53 is slidably positioned in a first channel 52 between each of the first actuator engaging areas 42 and 48. Similarly, and again referring to FIG. 1, a second actuator 53′ is slidably positioned in a second channel 54 between each of the second actuator engaging areas 43 and 49. The first actuator 53 and the second actuator 53′ each includes a first sloping ramp surface 55, a second sloping ramp surface 56, a first side surface 57 and a second side surface 58. The first sloping ramp 55 and the second sloping ramp 56 of the first actuator 53 are arranged to engage and spread apart first actuator engaging areas 42 and 48 when the actuator is slid past them within its channel 52. Similarly, the first sloping ramp 55 and the second sloping ramp 56 of the second actuator 53′ are arranged to engage and spread apart second actuator engaging areas 43 and 49 when the actuator is slid past them within its channel 54.

The actuators may be separately provided for each set of connection springs and may be positioned to simultaneously operate the springs. The actuators may be alternately offset or separately operatable with respect to each other to sequentially operate each set of connection springs.

The connector of the present invention is operated by sliding the actuators 53 and 53′ past each of the springs 39 and 45 to deflect the springs and place the first side surfaces 57 in contact with the actuator engaging areas 42 and 43 and the second side surfaces 58 in contact with actuator engaging areas 48 and 49 respectively. In this position, the first springs 39 and the second springs 45 are in their actuated positions. The first contacts 40 and 46 are out of engagement with the first contacts 3 and the second contacts 5 of the first printed wiring board 1. Similarly, the second contacts 41 and 47 are out of contact with the first terminals 8 and the second terminals 10 of the printed wiring board 2.

The printed wiring boards 1 and 2 may now be inserted into the first groove 16 and second groove 20 with low insertion force to the point where edges 7 and 12 abutt groove floors 19 and 23 respectively. Once inserted, the first terminal 3 of the first printed wiring board 1 may be connected to the first terminal 8 of the second printed wiring board 2 and the second terminal 5 of the first printed wiring board 1 may be connected to the second terminal 10 of the second printed wiring board 2 by sliding the actuators 53 and 53′. In this regard, the first actuator 53 is slid within the first channel 52 to remove the first actuator engaging areas 42 and 48 from engagement with the side surfaces 57 and 58. Once freed, the first spring 39 will pivot about the pivot point 44 acting against the fulcrum 28 to place the first contacts 40 into engagement with the first terminals 3. Similarly, the freed second spring 45 will pivot about the pivot point 50 acting against the fulcrum 29 to place the first contact 46 into engagement with the second terminal 5. In like manner, the actuator 53′ may be slide to remove it from engagement with the actuator engaging areas 43 and 49 to further pivot the springs 39 and 45 and engage the contacts 41 and 47 with terminals 8 and 10 respectively.

Positioning of the first springs 39 and the second springs 45 within each of the spring receiving cavities 24 is controlled by action of the fingers 51 of the springs against the upper edges 36 and the lower edges 37 of the first and second recesses 32 and 33.

While a linear type of actuator has been described, it will be appreciated that other types of actuators may be used to deflect the actuator engaging areas 42 and 48 or 43 and 49 away from each other to effect disengagement of the connector spring contacts from the printed wiring board terminals. In this regard, a rotary actuator (not shown) may be used, including a pair of opposite low points and a pair of opposite high points, with each low point located between two high points and each low point connected to each adjacent high point by a cam like surface. The rotary adjacent may be inserted between the actuator engaging areas 42 and 48 or 43 and 49 and rotated to deflect the actuator engaging areas away from each other.

Figure 4:
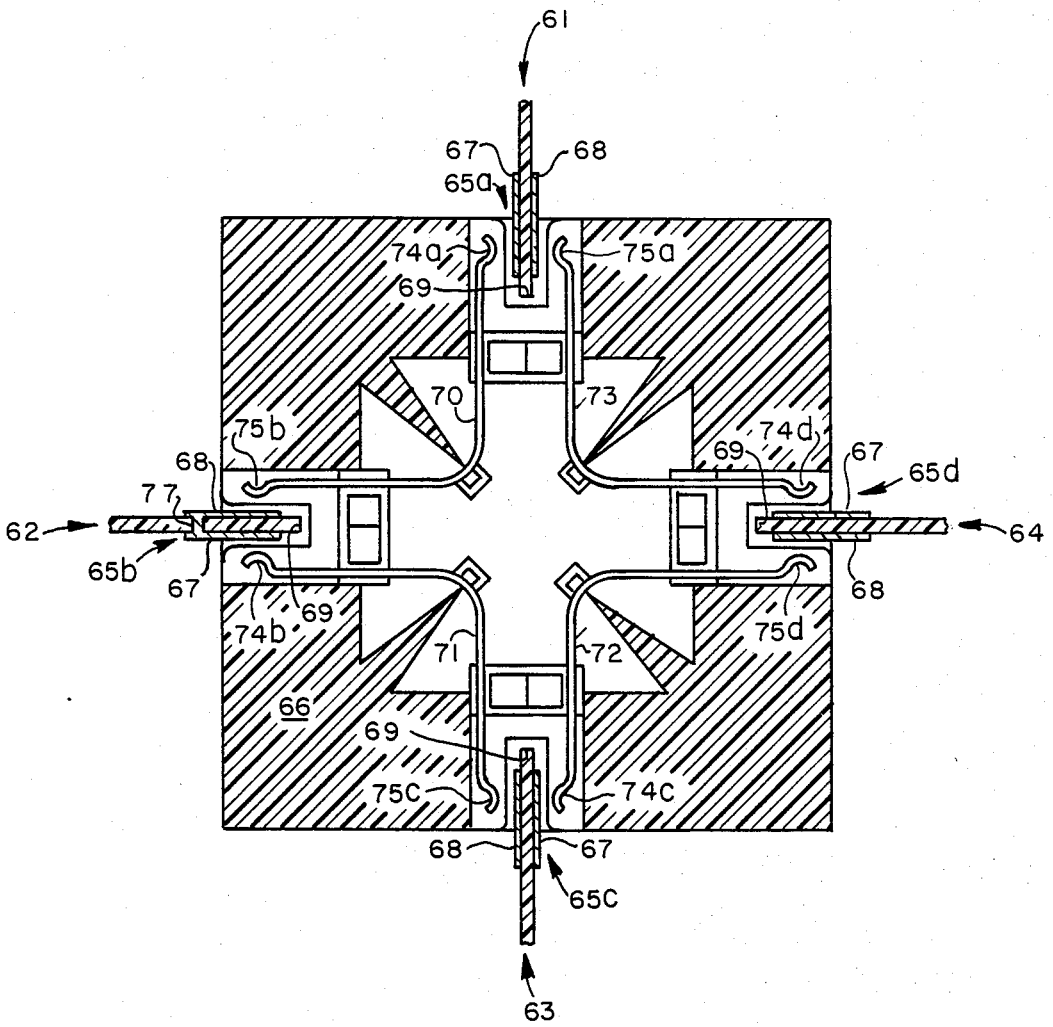
FIG. 4 is a cross sectional view of a zero insertion force connection arrangement for four printed wiring boards in accordance with the present invention.

It will also be appreciated that while the preferred embodiment described above connects two printed wiring boards together, more than two printed wiring boards may be connected in a similar manner. Referring to FIG. 4, there is shown an arrangement for connecting four printed wiring boards. In this regard, a first printed wiring board 61, a second printed wiring board 62, a third printed wiring board 63, and a fourth printed wiring board 64 are shown positioned within a plurality of grooves 65*a–d* of a connector body 66. Each printed wiring board includes a first set of terminals 67 and a second set of terminals 68 positioned near an edge 69 of the printed wiring board. Four pluralities of connection springs 70–73 are located between the facing surfaces of adjacent printed wiring boards and are positioned to engage corresponding ones of each of the first terminals 67 and the second terminals 68 via the first contacts 74*a–d* and the second contacts 75*a–d*, respectively. In this regard, the first terminal 67 of first printed wiring board 61 is connected to the second terminal 68 of the second printed wiring board 62 by the connection spring 70, and the contacts 74*a* and 75*b* thereof. Similarly, the first contact 67 of the second printed wiring board 62 may be connected to the second contact 68 of the third printed wiring board 63 by the connection spring 71 and the contacts 74*b* and 75*c* thereof. In like manner, the contacts of the fourth printed wiring board 64 may be connected to corresponding contacts of the first and third printed wiring boards 61 and 63.

Non-adjacent printed wiring boards may be connected by routing connections through intermediate printed wiring boards. In this regard, a connection may be formed between the first terminal 67 of the first printed wiring board 61 and the second terminal 68 of the third printed wiring board 63 by including a connection 77 between the first terminal 67 and the second terminal 68 of the second printed wiring board 62. The connection thus established would include the contact 74*a*, the spring 70, the contact 75*b*, the terminal 68 of the printed wiring board 62, the connection 77, the terminal 67 of the printed wiring board 62, the contact 74*b*, the spring 71, and the contact 75*c*.

Additional embodiments of the present invention may be realized by combining the details of the first embodiment with the details of the second embodiment. In this regard, a third embodiment (not shown) of the present invention may be constructed including a rear connector portion according to the embodiment of FIGS. 1 and 2, and a front connector portion according to the embodiment of FIG. 4. Additionally, a fourth embodiment (also not shown) of the present invention may be constructed including a left side portion according to the embodiment of FIGS. 1 and 2, and a right side portion according to the embodiment of FIG. 4. Such fourth embodiment would yield a three card interconnect connector.

It will now be apparent that a low insertion force arrangement for connecting a plurality of printed wiring boards has been described hereinabove which provides improvements over prior art assemblies. The arrangement may be used to interconnect two printed wiring boards according to the embodiment shown in FIGS. 1 through 3 or the invention may be used to interconnect more than two printed wiring boards as shown in the embodiment of FIG. 4. Two additional embodiments of the present invention have been mentioned which result from the combination of features of the first two embodiments in different manners.

While but four embodiments of the present invention have been disclosed, it will be appreciated by those skilled in the art that numerous modifications of the present invention may be made without departing from the spirit of the invention which shall be limited only by the scope of the claims appended hereto.

What is claimed is:

1. In combination, a first printed wiring board and a second printed wiring board, each printed wiring board including at least one terminal, and a low insertion force arrangement for establishing a connection between said printed wiring boards, said arrangement comprising:

at least one connection spring, said spring including first and second contacts, a pivot point, and first and second actuator engaging areas, said pivot point located between said actuator engaging areas, and said contacts each engageably positioned relative to a corresponding terminal of a respective one of said printed wiring boards;

a fulcrum positioned to engage said spring at said pivot point; and first and second actuators located proximate to said spring at said first and said second actuator engaging areas respectively, said actuators each positioned in a first position relative to said spring to pivot said spring about said pivot point and engage a respective one of said contacts with said terminal of a respective one of said printed wiring boards, and positioned in a second position relative to said spring to pivot said spring about said pivot point and disengage said respective contact from said terminal of said respective printed wiring board.

2. An arrangement as claimed in claim 1, wherein: said connection spring is of elongated construction.

3. An arrangement as claimed in claim 1, wherein: said contacts are each located on said spring facing corresponding ones of said printed wiring boards.

4. An arrangement as claimed in claim 1, wherein: said pivot point is located between said contacts.

5. An arrangement as claimed in claim 1, wherein: said pivot point is located on said spring facing away from at least one of said printed wiring boards.

6. An arrangement as claimed in claim 1, wherein: said actuator engaging areas are located between said contacts.

7. An arrangement as claimed in claim 1, wherein: said actuator engaging areas are each located on said spring facing at least one of said printed wiring boards.

8. An arrangement as claimed in claim 1, wherein: said connection spring is positioned generally parallel to and overlapping said printed wiring board terminals.

9. An arrangement as claimed in claim 2, wherein: said contacts are positioned proximate opposite ends of said spring.

10. An arrangement as claimed in claim 1, wherein: said actuators each include a sloping ramp positioned proximate to said respective ones of said actuator engaging areas, said ramps each engaging said respective engaging areas when said actuators are linearly positioned between said first and said second actuator positions to pivot said spring.

11. In combination, a first printed wiring board and a second printed wiring board, each printed wiring board including at least one terminal, and a low insertion force arrangement for establishing a connection between said printed wiring boards, said arrangement comprising:

at least one connection spring, said spring including first and second contacts, a pivot point, and first and second actuator engaging areas, said contacts each engageably positioned relative to a corresponding terminal of a respective one of said printed wiring a fulcrum positioned to engage said spring at said pivot point first and second actuators located proximate to said spring at said first and said second actuator engaging areas respectively, said actuators each positioned in a first position relative to said spring to pivot said spring about said pivot point and engage a respective one of said contacts with said terminal of a respective one of said printed wiring boards, and positioned in a second position relative to said spring to pivot said spring about said pivot point and disengage said respective contact from said terminal of said respective printed wiring board; and a connector body including at least one spring receiving cavity and at least two printed wiring board receiving cavities; said connection spring positioned within said spring receiving cavity, said printed wiring boards positioned within a respective one of said printed wiring board receiving cavities, and said printed wiring board receiving cavities positioned at an angle to each other.

12. An arrangement as claimed in claim 11, wherein: said fulcrum is formed as part of said connector body.

13. An arrangement as claimed in claim 11, wherein: said connection spring includes retaining means, said retaining means positioning said connection spring relative to both of said printed wiring boards while permitting pivotal movement of said spring about said pivot point.

14. An arrangement as claimed in claim 13, wherein: said retaining means includes a pair of fingers connected to said spring at points laterally opposite one another, said fingers extending in a direction away from said spring.

15. An arrangement as claimed in claim 14, wherein: said fingers are connected to said connection spring at said pivot point.

16. An arrangement as claimed in claim 14, wherein: said spring receiving cavity is formed including a pair of opposing walls, each wall including a retainer recess, said recesses formed opposite one another, said fingers positioned within said recesses.

17. An arrangement as claimed in claim 11, wherein: said terminal is formed on a first side of each of said printed wiring boards.

18. An arrangement as claimed in claim 11, wherein: said printed wiring boards each include at least one terminal formed on a first and a second side of each of said printed wiring boards and said arrangement includes a plurality of connection springs positioned within said connector body spring receiving cavity.

19. An arrangement as claimed in claim 18, wherein: selected ones of said printed wiring board terminals are interconnected.

20. An arrangement as claimed in claim 18, wherein: said arrangement includes at least three printed wiring boards and said connection springs connect corresponding terminals on surfaces of adjacent printed wiring boards facing each other.

* * * * *